US010686275B2

(12) United States Patent
Li

(10) Patent No.: US 10,686,275 B2
(45) Date of Patent: Jun. 16, 2020

(54) MOBILE TERMINAL, POWER INTERFACE, AND METHOD FOR MANUFACTURING POWER INTERFACE

(71) Applicant: GUANGDONG OPPO MOBILE TELECOMMUNICATIONS CORP., LTD., Dongguan, Guangdong (CN)

(72) Inventor: Feifei Li, Guangdong (CN)

(73) Assignee: GUANGDONG OPPO MOBILE TELECOMMUNICATIONS CORP., LTD., Dongguan, Guangdong (CN)

( * ) Notice: Subject to any disclaimer, the term of this patent is extended or adjusted under 35 U.S.C. 154(b) by 0 days.

(21) Appl. No.: 16/440,238

(22) Filed: Jun. 13, 2019

(65) Prior Publication Data

US 2019/0296475 A1 Sep. 26, 2019

Related U.S. Application Data

(63) Continuation of application No. 16/253,713, filed on Jan. 22, 2019, and a continuation of application No. PCT/CN2017/081266, filed on Apr. 20, 2017.

(30) Foreign Application Priority Data

Jul. 27, 2016 (CN) ..... 2016 1 0603134
Jul. 27, 2016 (CN) ..... 2016 2 0806349 U

(51) Int. Cl.
*H01R 24/60* (2011.01)
*H01R 13/502* (2006.01)
(Continued)

(52) U.S. Cl.
CPC ..... *H01R 13/502* (2013.01); *H01R 12/722* (2013.01); *H01R 13/26* (2013.01);
(Continued)

(58) Field of Classification Search
CPC ..... H01R 24/60; H01R 12/722
See application file for complete search history.

(56) References Cited

U.S. PATENT DOCUMENTS

2013/0136958 A1 5/2013 Nakano et al.
2014/0134887 A1 5/2014 Soubh et al.
(Continued)

FOREIGN PATENT DOCUMENTS

CN 2359813 Y 1/2000
CN 2653733 Y 11/2004
(Continued)

OTHER PUBLICATIONS

A first Chinese Office Action dated Jul. 13, 2017 for Application No. CN 201610603134.1.
(Continued)

*Primary Examiner* — Tho D Ta
(74) *Attorney, Agent, or Firm* — Ladas & Parry LLP

(57) ABSTRACT

A power interface may include a housing and a connection body. The housing has an inner wall defining a stopping groove. The connection body is disposed in the housing and includes a first encapsulation portion and a plurality of pins spaced apart. The pins are wrapped by the first encapsulation portion, and a partial outer face of each of the pins is exposed by the first encapsulation portion. The first encapsulation portion is connected to the housing. The first encapsulation portion is made from polyamide resin and has an engaging flange arranged adjacent an end of the pins, and the engaging flange is engaged in the stopping groove.

20 Claims, 6 Drawing Sheets

(51) Int. Cl.

| | |
|---|---|
| ***H01R 12/72*** | (2011.01) |
| ***H01R 13/504*** | (2006.01) |
| ***H01R 13/26*** | (2006.01) |
| *H01R 12/55* | (2011.01) |
| *H01R 107/00* | (2006.01) |

(52) U.S. Cl.
CPC ..... *H01R 13/5045* (2013.01); *H01R 12/55* (2013.01); *H01R 24/60* (2013.01); *H01R 2107/00* (2013.01)

(56) References Cited

U.S. PATENT DOCUMENTS

| | | | | |
|---|---|---|---|---|
| 2015/0200504 | A1* | 7/2015 | Little | H01R 24/60 439/345 |
| 2015/0236441 | A1* | 8/2015 | Kim | H01R 13/521 439/587 |
| 2015/0244101 | A1* | 8/2015 | Chien | H01R 13/5202 439/271 |
| 2016/0372876 | A1 | 12/2016 | Zhang et al. | |
| 2017/0162976 | A1 | 6/2017 | Zhao et al. | |

FOREIGN PATENT DOCUMENTS

| | | | |
|---|---|---|---|
| CN | 201018063 | Y | 2/2008 |
| CN | 201142397 | Y | 10/2008 |
| CN | 201181751 | Y | 1/2009 |
| CN | 201797116 | U | 4/2011 |
| CN | 102683984 | A | 9/2012 |
| CN | 203277778 | U | 11/2013 |
| CN | 203481470 | U | 3/2014 |
| CN | 203690612 | U | 7/2014 |
| CN | 203707453 | U | 7/2014 |
| CN | 203774570 | U | 8/2014 |
| CN | 204011820 | U | 12/2014 |
| CN | 204179278 | U | 2/2015 |
| CN | 204205112 | U | 3/2015 |
| CN | 204271346 | U | 4/2015 |
| CN | 104810640 | A | 7/2015 |
| CN | 104882705 | A | 9/2015 |
| CN | 204858190 | U | 12/2015 |
| CN | 204927628 | U | 12/2015 |
| CN | 205016742 | U | 2/2016 |
| CN | 105428854 | A | 3/2016 |
| CN | 105449398 | A | 3/2016 |
| CN | 105680247 | A | 6/2016 |
| CN | 205282692 | U | 6/2016 |
| CN | 205355368 | U | 6/2016 |
| CN | 106025615 | A | 10/2016 |
| CN | 106252924 | A | 12/2016 |
| CN | 205882208 | U | 1/2017 |
| CN | 205960255 | U | 2/2017 |
| EP | 2571107 | A2 | 3/2013 |
| WO | WO2014033581 | A1 | 3/2014 |

OTHER PUBLICATIONS

An International Search Report (ISR) and Written Opinion (WO) dated Jul. 21, 2017 for Application No. PCT/CN2017/081266.

A second Chinese Office Action dated Oct. 30, 2017 for Application No. CN 201610603134.1.

A Notification to Grant Patent Right for Invention dated Feb. 11, 2018 for Application No. CN 201610603134.1.

A first Chinese Office Action dated Mar. 26, 2019 for Application No. CN 201810214591.0.

A Supplementary European Search Report (SESR) dated May 23, 2019 for Application No. EP 17833259.9, and references cited therein.

First Office Action from China patent office in a counterpart Chinese patent Application 201610603134.1, dated Jul. 13, 2017 (5 pages).

International search report for Appliction No. PCT/CN2017/081266, dated Jul. 21, 2017 (10 pages).

Second Office Action from China patent office in a counterpart Chinese patent Application 201610603134.1, dated Oct. 30, 2017 (3 pages).

The National Intellectual Property Administration of People's Republic of China, Notification of Grant Patent for CN Application 201610603134.1, dated Feb. 11, 2018 (1 pages).

First Office Action from China patent office in a counterpart Chinese patent Application 201810214591.0, dated Mar. 26, 2019 (10 pages).

European search report for Application No. EP17833259.9, dated May 23, 2019 (7 pages).

A first Chinese Office Action with an English translation dated Jun. 5, 2019 for Application No. CN 201810254024.8.

A second Chinese Office Action with an English translation dated Jul. 16, 2019 for Application No. CN 201810214591.0, and references cited therein.

First Office Action from China patent office in a counterpart Chinese patent Application 201810254024.8, dated Jun. 5, 2019 (15 pages).

Second Office Action from China patent office in a counterpart Chinese patent Application 201810214591.0, dated Jul. 16, 2019 (20 pages).

First office action and Written Opinion by State Intellectual Property Office of the people's Republic of China ("SIPO") in related Chinese application No. 201610603150, dated Jul. 13, 2017 (6 pages).

Second office action and Written Opinion by SIPO in related Chinese application No. 201610603150, dated Oct. 30, 2017 (5 pages).

First office action and Written Opinion by SIPO in related Chinese application No. 201810215695, dated Mar. 26, 2019 (10 pages).

Second office action and Written Opinion by SIPO in related Chinese application No. 201810215695, dated Jul. 16, 2019 (11 pages).

Third office action and Written Opinion by SIPO in related Chinese application No. 201810215695, dated Sep. 29, 2019 (11 pages).

First office action and Written Opinion by SIPO in related Chinese application No. 201810207743, dated Mar. 1, 2019 (4 pages).

U.S. Non Final Action and Written Opinion by United States Patent and Trademark Office ("USPTO") in related U.S. Appl. No. 16/254,289, dated Sep. 13, 2019 (35 pages).

U.S. Non Final Action and Written Opinion by USPTO in related U.S. Appl. No. 16/440,681, dated Sep. 13, 2019 (29 pages).

International Search Report and Written Opinion by SIPO in related PCT application No. PCT/CN2017/081267, dated Jul. 27, 2017 (16 pages).

* cited by examiner

MOBILE TERMINAL, POWER INTERFACE, AND METHOD FOR MANUFACTURING POWER INTERFACE

CROSS REFERENCE TO RELATED APPLICATIONS

The present application is a continuation-application of U.S. patent application Ser. No. 16/253,713 filed on Jan. 22, 2019, which is a continuation-application of International (PCT) Patent Application No. PCT/CN2017/081266 filed Apr. 20, 2017, which claims foreign priorities of Chinese Patent Application No. 201610603134.1, filed on Jul. 27, 2016 and Chinese Patent Application No. 201620806349.9, filed on Jul. 27, 2016, the entire contents of which are hereby incorporated by reference in their entireties.

TECHNICAL FIELD

The present disclosure relates to communication technology, and in particular to a power adapter, a mobile terminal, a power interface, and a method for manufacturing the power interface.

BACKGROUND

With the advancement of times, Internet and mobile communication networks provide a huge number of functional applications. Users can use mobile terminals not only for traditional applications, for example, using smart phones to answer or make calls, but also for browsing web, transferring picture, playing games, and the like at the same time.

While using a mobile terminal to handle things, due to the increase in frequencies of using the mobile terminals, it will consume a large amount of powers of batteries in the mobile terminals, such that the batteries need to be charged frequently, and then the power interface is also prone to fatigue damage.

SUMMARY OF THE DISCLOSURE

According to one aspect of the present disclosure, a power interface is provided. The power interface may include a housing and a connection body. The housing has an inner wall defining a stopping groove. The connection body is disposed in the housing and includes a first encapsulation portion, a second encapsulation portion, and a plurality of pins spaced apart. Partial outer periphery of the pins is wrapped by the first encapsulation portion, and a partial outer face of each of the pins is exposed out of the first encapsulation portion. The first encapsulation portion is connected to the housing. The first encapsulation portion is made from polyamide resin and has an engaging flange arranged adjacent an end of the pins, and the engaging flange is engaged in the stopping groove. The second encapsulation portion is embedded in the first encapsulation portion, and a partial outer peripheral wall of the second encapsulation portion is configured as a front-end surface of the connection body.

According to another aspect of the present disclosure, a mobile terminal is provided. The mobile terminal may include a power interface. The power interface may include a housing and a connection body. The housing has an inner wall defining a stopping groove. The connection body is disposed in the housing and includes a first encapsulation portion, a second encapsulation portion, and a plurality of pins spaced apart. Partial outer periphery of the pins is wrapped by the first encapsulation portion, and a partial outer face of each of the pins is exposed out of the first encapsulation portion. The first encapsulation portion is connected to the housing. The first encapsulation portion is made from polyamide resin and has an engaging flange arranged adjacent an end of the pins, and the engaging flange is engaged in the stopping groove. The second encapsulation portion is embedded in the first encapsulation portion, and a partial outer peripheral wall of the second encapsulation portion is configured as a front-end surface of the connection body.

According to yet another aspect of the present disclosure, a method for manufacturing a power interface is provided. The power interface may include a housing and a connection body disposed in the housing. The connection body may include a first encapsulation portion, a second encapsulation portion, and a plurality of pins spaced apart, wherein partial outer periphery of the pins is wrapped by the first encapsulation portion and the second encapsulation portion, the first encapsulation portion is connected to the housing, the second encapsulation portion is embedded in the first encapsulation portion, a part of an outer peripheral wall of the second encapsulation portion is configured to be a front-end surface of the connection body, and at least one of the first encapsulation portion and the second encapsulation portion is made from polyamide resin. The method may include S10) performing a first encapsulation process on the pins to form the first encapsulation portion; S20) performing a second encapsulation process on the first encapsulation portion to form the second encapsulation portion, wherein the pins, the first encapsulation portion, and the second encapsulation portion are collectively configured to form the connection body; S30) mounting the connection body into the housing.

DETAILED DESCRIPTION

Figure 1:
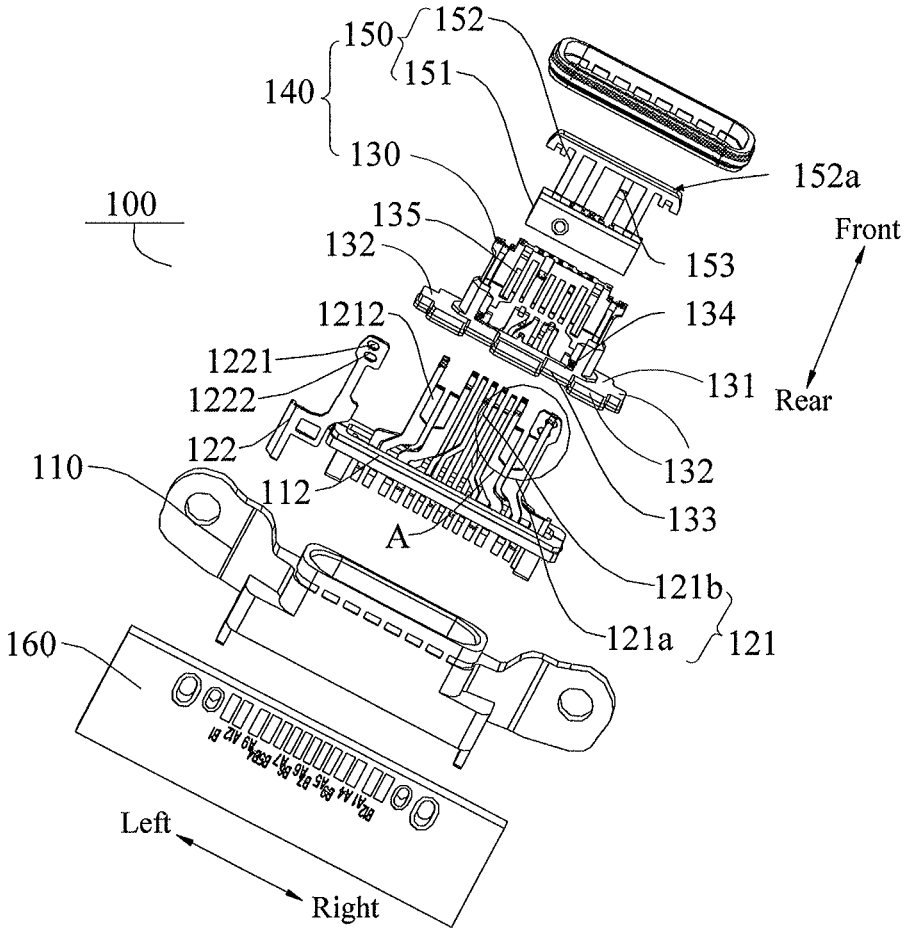
FIG. 1 is an explored view of a power interface according to an embodiment of the present disclosure.
Figure 2:
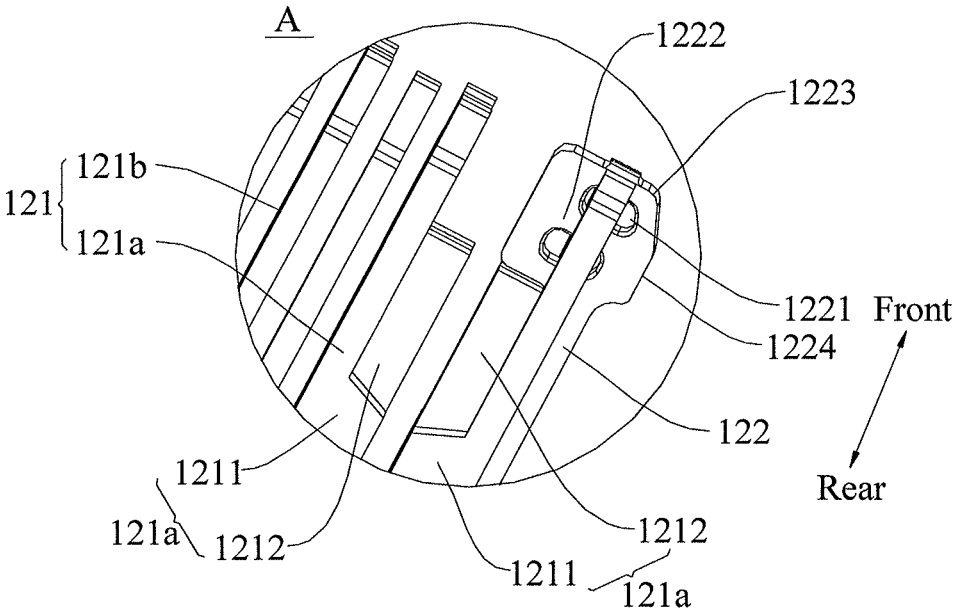
FIG. 2 is a partial enlarged view of portion A in FIG. 1.

Embodiments of the present disclosure will be described in detail below, and examples of the embodiments will be illustrated in the accompanying drawings. The embodiments described below with reference to the drawings are illustrative and are intended to explain the present disclosure, and cannot be construed as a limitation to the present disclosure.

In the description of the present disclosure, it is to be understood that terms such as "length", "width", "thickness", "upper", "lower", "front", "rear", "left", "right", "bottom", "inner", "outer", "circumference", and the like, refer to the orientations and locational relations illustrated in the accompanying drawings. Thus, these terms used here are only for describing the present disclosure and for describing in a simple manner, and are not intended to indicate or imply that the device or the elements are disposed to locate at the specific directions or are structured and performed in the specific directions, which could not to be understood as limiting the present disclosure.

In addition, terms such as "first", "second", and the like are used herein for purposes of description, and are not intended to indicate or imply relative importance or significance or to imply the number of indicated technical features. Thus, the feature defined with "first", "second", and the like may include one or more of such a feature. In the description of the present disclosure, "a plurality of" means two or more, such as two, three, and the like, unless specified otherwise.

In the present disclosure, unless specified or limited, otherwise, terms "mounted", "connected", "coupled", "fixed", and the like are used in a broad sense, and may include, for example, fixed connections, detachable connections, or integral connections; may also be mechanical or electrical connections; may also be direct connections or indirect connections via intervening structures; may also be inner communications of two elements, as can be understood by one skilled in the art depending on specific contexts.

A power interface is provided. The power interface may include a housing and a connection body. The housing has an inner wall defining a stopping groove. The connection body is disposed in the housing and includes a first encapsulation portion and a plurality of pins spaced apart. The pins are wrapped by the first encapsulation portion, and a partial outer face of each of the pins is exposed out of the first encapsulation portion. The first encapsulation portion is connected to the housing. The first encapsulation portion is made from polyamide resin and has an engaging flange arranged adjacent an end of the pins, and the engaging flange is engaged in the stopping groove.

In one embodiment, the stopping groove extends along a circumferential direction of the inner wall and surrounds the connection body.

In one embodiment, a plurality of engaging protrusions are circumferentially arranged on the engaging flange and surround the connection body; and an engaging portion arranged on the inner wall where the stopping groove is defined, and the engaging protrusions are engaged with the engaging portion.

In another embodiment, a plurality of stopping protrusions are circumferentially disposed on the inner wall where a stopping groove is disposed, and the plurality of stopping protrusions are embedded in the first encapsulation portion.

In one embodiment, the engaging flange defines a plurality of engaging recesses spaced along a circumferential direction of the engaging flange, and the plurality of stopping protrusions are correspondingly engaged in the plurality of engaging recesses.

In one embodiment, an adhesive layer is circumferentially disposed between the first encapsulation portion and the inner wall of the housing.

In one embodiment, the connection body further include a second encapsulation portion. The second encapsulation portion is embedded in the first encapsulation portion. An outer surface of the second encapsulation portion is configured as a part of a surface of the connection body.

In one embodiment, the first encapsulation portion defines a body-embedding notch and an extension-embedding notch. The second encapsulation portion includes a body-embedding portion and an extension-embedding portion connected to the body-embedding portion. The body-embedding portion is embedded in the body-embedding notch, and the extension-embedding portion is embedded in the extension-embedding notch. Outer surfaces of the extension-embedding portion and the body-embedding portion are configured as the part of the surface of the connection body.

In one embodiment, one of the first encapsulation portion and the second encapsulation portion defines a receiving groove, and an embedding protrusion is arranged on the other one of the first encapsulation portion and the second encapsulation portion, wherein the embedding protrusion is embedded in the receiving groove.

In one embodiment, the second encapsulation portion is made from polyamide resin.

In one embodiment, the pins comprise power pins and data pins, at least one of the power pins has an expanded portion, and a cross-sectional area of the expanded portion is greater than that of each of the data pins to increase current load of the power pin.

In one embodiment, the expanded portion defines a pin-recess close to an end of the power pin.

In one embodiment, the power interface further includes a first stopping plate and a second stopping plate arranged on the inner wall, wherein the stopping groove is defined by both the first stopping plate and the second stopping plate.

A mobile terminal is also provided. The mobile terminal may include a circuit board and a power interface connected to the circuit board. The power interface may include a housing and a connection body. The housing has an inner wall defining a stopping groove. The connection body is disposed in the housing and includes a first encapsulation portion and a plurality of pins spaced apart. The pins are wrapped by the first encapsulation portion, and a partial outer face of each of the pins is exposed by the first encapsulation portion. The first encapsulation portion is connected to the housing. The first encapsulation portion is made from polyamide resin and has an engaging flange arranged adjacent an end of the pins, and the engaging flange is engaged in the stopping groove.

A power interface is also provided. The power interface may include a housing and an insertion body received in the housing. The insertion body may include a plurality of pins, an encapsulation, and a plurality of spaced engaging flanges. The encapsulation is connected to the housing and wrapped the pins partially such that a partial outer surface of each of the pins is exposed out of the encapsulation. The encapsulation is made from polyamide resin. A plurality of spaced engaging flanges extends out from an external circumference of the encapsulation adjacent to an end of the pins.

In one embodiment, each two adjacent pins are insulated by the encapsulation, and exposed outer surfaces of the each two adjacent pins are coplanar with an outer surface of the encapsulation between the each two adjacent pins.

In one embodiment, each two adjacent pins are insulated by the encapsulation, and exposed outer surfaces of the each two adjacent pins extend beyond an outer surface of the encapsulation between the each two adjacent pins.

In one embodiment, the housing defines a plurality of recesses, and the engaging flanges are engaged in the recesses.

In one embodiment, two adjacent engaging flanges define a groove, and a protrusion extends from the housing to be engaged in the groove.

In one embodiment, the engaging flanges extend along a direction perpendicular to an extending direction of the pins.

In the following, a power interface 100 may be will be described in detail in embodiments of the present disclosure with reference to FIGS. 1-10. It should be understood that, the power interface 100 may include an interface for charging or data transmission, and may be disposed in a mobile terminal such as a mobile phone, a tablet computer, a laptop, or any other suitable mobile terminal having a rechargeable function. The power interface 100 may be electrically connected to a corresponding power adapter to achieve a communication of electrical signals and data signals.

Hereafter, the term "left-right direction" used in the present disclosure may refer to a length direction of the power interface 100. The term "front-rear direction" used in the present disclosure may refer to a height direction of the power interface 100. It will be appreciated that the directions defined here are only for explanation, not for limitation.

Referring to FIGS. 1-10, the power interface 100 according to an embodiment of the present disclosure may include a housing 110 and a connection body 120.

Specifically, a stopping groove 113 is provided on the inner wall 110*a* of the housing 110. The connection body 120 is disposed in the housing 110. The connection body 120 includes a first encapsulation portion 130 and a plurality of pins 121 spaced apart. Partial outer periphery of the pins 121 is wrapped by the first encapsulation portion 130, that is, the pins 121 are wrapped by the first encapsulation portion 130, and a partial outer face of each pin 121 is exposed by the first encapsulation portion 130. The first encapsulation portion 130 is connected to the housing 110. It should be noted that a surface of the pins 121 uncovered by the first encapsulation portion 130 is configured to be an outer surface of the connection body 120, and the surface of the pins 121 uncovered by the first encapsulation portion 130 is adapted to be electrically connected to corresponding pins 121 in a power adapter.

It can be understood that, since the plurality of pins 121 are wrapped together by the first encapsulation portion 130, the structural strength of the connection body 120 can be enhanced, and fatigue damage of the connection body 120 may be delayed during repeated insertion of the connection body 120. The first encapsulation portion 130 has an engaging flange 131 arranged close to a rear end of the pins 121 (i.e., the rear side direction as shown in FIG. 1), that is, the engaging flange 131 is arranged adjacent to the rear end of the pins 121. The engaging flange 131 is engaged in the stopping groove 113. Thus, the connection body 120 can be stably mounted in the housing 110.

The first encapsulation portion 130 is a polyamide resin encapsulation portion. As polyamide resin has a good heat dissipation effect, the heat dissipation requirement of the connection body 120 can be satisfied. It should be noted that a large amount of heat may be produced when the power interface 100 is charged, especially when it is fast charged. The accumulated heat has a more obvious effect on current transmission.

For the power interface 100 according to an embodiment of the present disclosure, the first encapsulation portion 130 is made from polyamide resin with a high conductivity and a good heat dissipation effect. Thus, the heat produced by the current during charging can be effectively conducted, which facilitates the power interface to have the fast-charging function.

Figure 6:
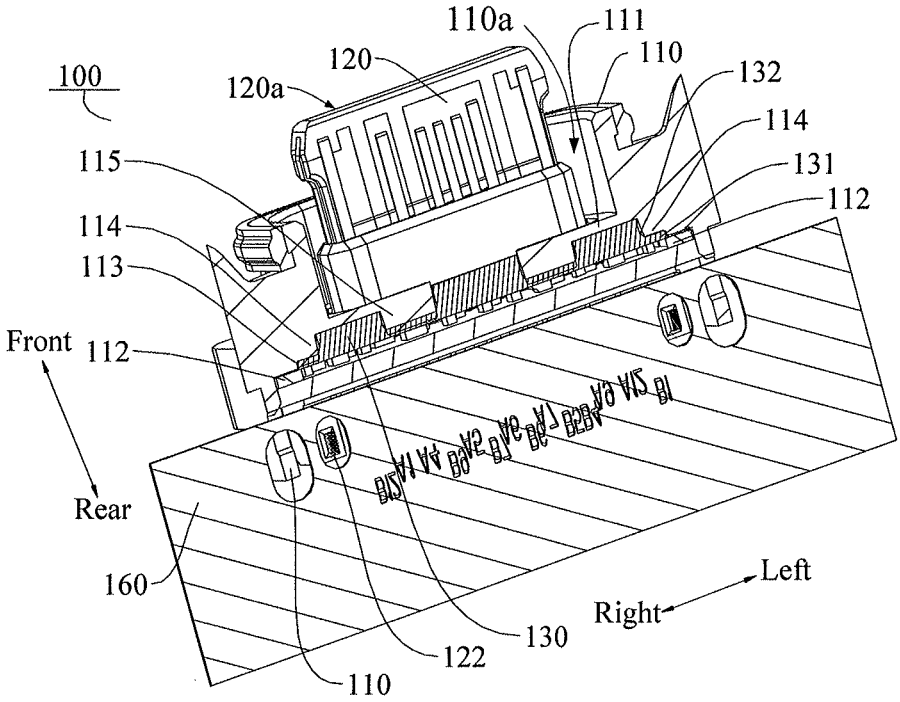
FIG. 6 is a cutaway view of a power interface according to an embodiment of the present disclosure.
Figure 7:
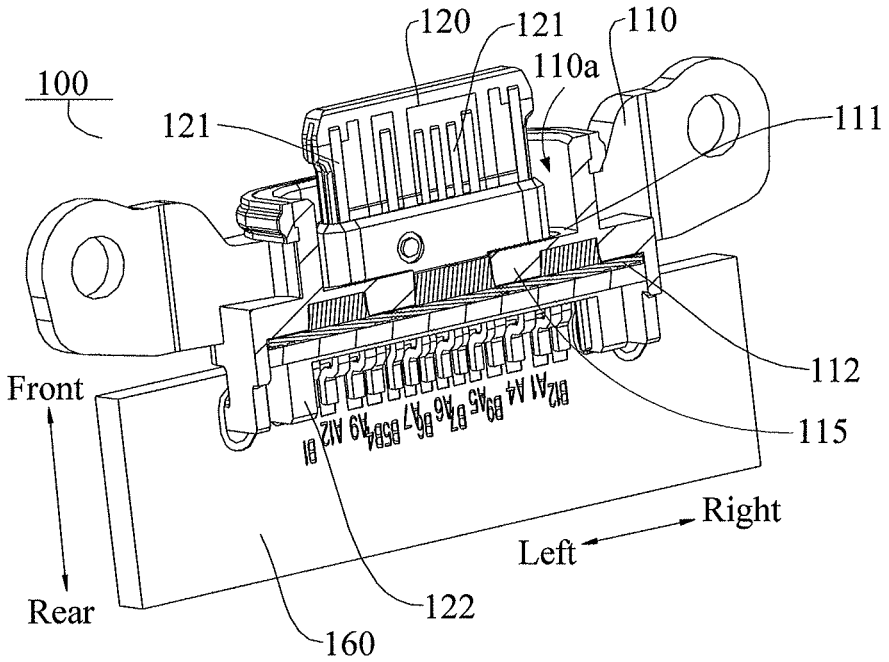
FIG. 7 is a cutaway view of a power interface according to an embodiment of the present disclosure.
Figure 8:
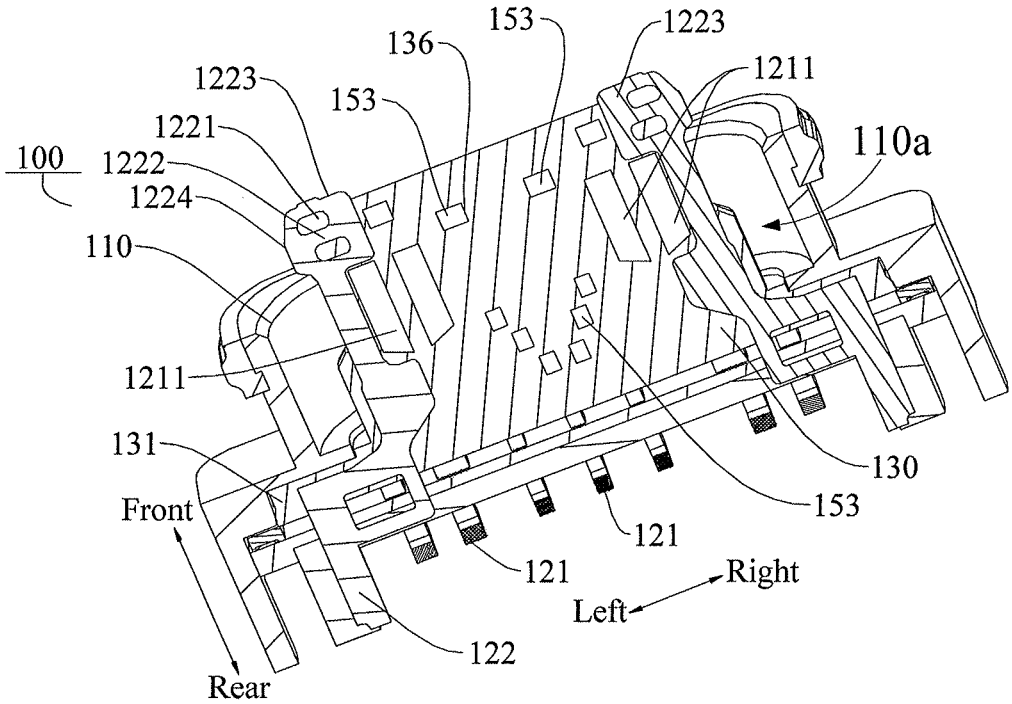
FIG. 8 is a cutaway view of a power interface according to an embodiment of the present disclosure.

According to an embodiment of the present disclosure, as shown in FIGS. 6-8, the stopping groove 113 extends in the circumferential direction of the connection body 120, that is, the stopping groove 113 extends along a circumferential direction of the inner wall 110*a* of the housing 110 and surrounds the connection body 120. Therefore, the stopping groove 113 can be firmly engaged with the engaging flange 131. Thus, the connection body 120 can be stably assembled in the housing 110, which further enhances reliability of the connection between the connection body 120 and the housing 110.

Figure 3:
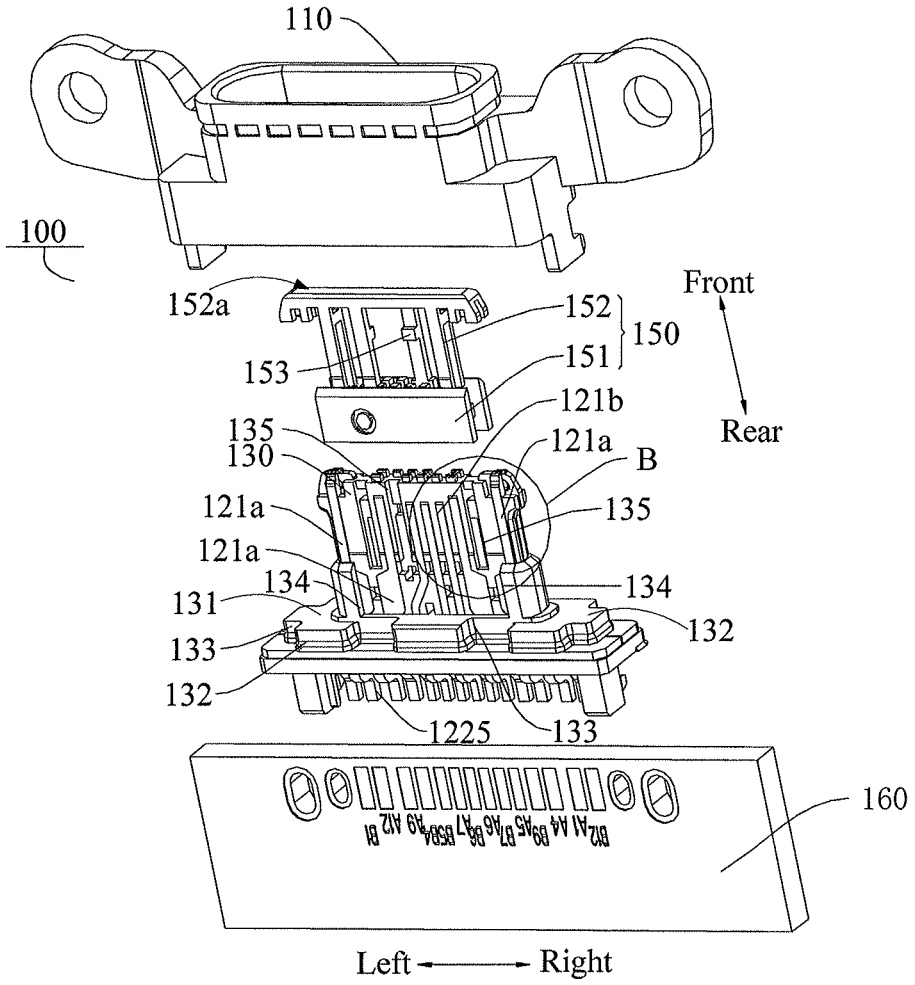
FIG. 3 is an explored view of a power interface according to an embodiment of the present disclosure.

Further, as shown in FIG. 1 and FIG. 3, a plurality of engaging protrusions 132 are arranged on a free end face of the engaging flange 131. An engaging portion 114 is arranged in the stopping groove 113, which are adapted to the engaging protrusions 132. Therefore, the contact area between the engaging flange 131 and the stopping groove 113 may be increased, which improves the mating stability of the connection body 120 and the housing 110. That is, the plurality of engaging protrusions 132 are circumferentially arranged on the engaging flange 131, and the engaging protrusions 132 surround the connection body 120. The engaging protrusions 132 are engaged with the engaging portion 114. In one example, the engaging portion 114 may define a plurality of engaging grooves (not shown), and the engaging protrusions 132 are then engaged in the engaging grooves.

According to another embodiment of the present disclosure, as shown in FIG. 6 and FIG. 7, a plurality of stopping protrusions 115 are arranged on an inner wall 110*a* where the stopping groove 113 is defined, and the stopping protrusions 115 are embedded in the first encapsulation portion 130. Further, in an example as shown in FIG. 1 and FIG. 3 together, the engaging flange 131 defines a plurality of engaging recesses 133, and the plurality of engaging recesses 133 are spaced along the circumferential direction of the engaging flange 131. The plurality of stopping protrusions 115 are adapted to the engaging recesses 133, that is, the stopping protrusions 115 are engaged in the engaging recesses 133 correspondingly. Thus, the stopping protrusions 115 is embedded in the first encapsulation portion 130. Therefore, the mating stability of the connection body 120 and the housing 110 may be further improved. Thus, as the stopping protrusions 115 are provided, which are embedded in the first encapsulation portion 130, the friction between the stopping groove 113 and the first encapsulation portion 130 may be increased. Thus, the assembly stability of the connection body 120 and the housing 110 can be improved.

According to an embodiment of the present disclosure, an adhesive layer is disposed between the first encapsulation portion 130 and the inner peripheral wall of the housing 110, that is, the adhesive layer is circumferentially disposed between the first encapsulation portion 130 and the inner wall 110*a* of the housing 110. On the one hand, the connection body 120 can be firmly and stably assembled with the housing 110. On the other hand, the connection body 120 and the housing 110 can be connected together by the adhesive layer, and the plugging strength of the power interface 100 also can be improved, which delays the fatigue damage of the power interface 100 due to repeated plug-in and plug-out actions.

As shown in FIGS. 1-4, according to an embodiment of the present disclosure, the connection body 120 further includes a second encapsulation portion 150. The second encapsulation portion 150 is embedded in the first encapsulation portion 130, and a part of the outer peripheral wall of the second encapsulation portion 150 is configured as a front-end face 120*a* of the connection body 120. That is, the outer surface of the second encapsulation portion 150 is configured as a part of the surface of the connection body 120. It should be noted that, as the two encapsulation portions are arranged on the connection body 120, the connection body 120 can have different characteristics. For example, the first encapsulation portion 130 and the second encapsulation portion 150 can be made from different materials. The connection body 120 can be made to meet different strength requirements by using different materials. In addition, the connection body 120 can also meet different heat dissipation requirements by selecting different materials. Of course, the connection body 120 can also have aesthetic appearance characteristics as the first encapsulation portion 130 and the second encapsulation portion 150 are used.

Figure 4:
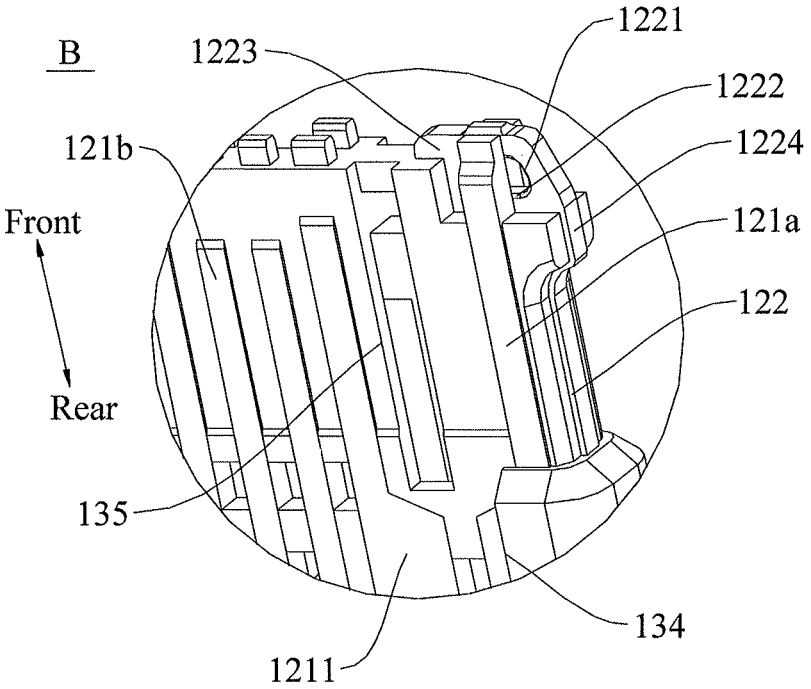
FIG. 4 is a partial enlarged view of portion B in FIG. 3.
Figure 5:
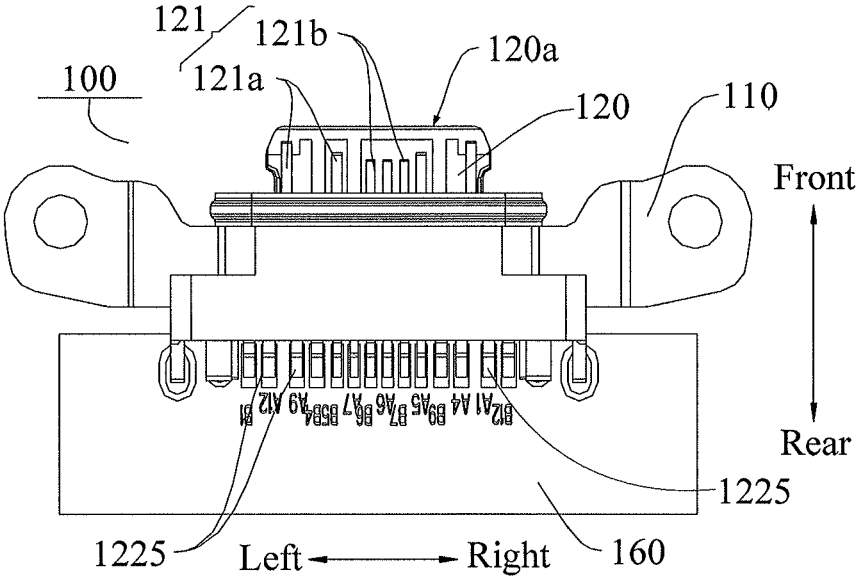
FIG. 5 is a structural schematic view of a power interface according to an embodiment of the present disclosure.

According to an embodiment of the present disclosure, as shown in FIGS. 3-4, the first encapsulation portion 130 defines a body-embedding notch 134 and an extension-embedding notch 135. Correspondingly, the second encapsulation portion 150 includes a body-embedding portion 151 and an extension-embedding portion 152. The body-embedding portion 151 is connected to the extension-embedding portion 152. The body-embedding portion 151 is embedded in the body-embedding notch 134, and the extension-embedding portion 152 is embedded in the extension-embedding notch 135. A front-end face 152*a* of the extension-embedding portion 152 is configured to be the front-end face 120*a* of the connection body 120. That is, one face of the extension-embedding portion 152 is configured as the front-end face 120*a* of the entire connection body 120. Therefore, in other words, the outer surfaces of the extension-embedding portion 152 and the body-embedding portion 151 are configured as the part of the surface of the connection body 120. Thus, the first encapsulation portion 130 and the second encapsulation portion 150 can be stably connected together. It can be understood that the pins 121 are wrapped by the first encapsulation portion 130 and the second encapsulation portion 150 such that the connection body 120 is formed. Due to the body-embedding portion 151 and the body-embedding notch 134, and the extension-embedding portion 152 and the extension-embedding notch 135, the pins 121, the first encapsulation portion 130, and the second encapsulation portion 150 are firmly assembled together, which may improve the structural strength and assembly stability of the connection body 120.

Further, an embedding protrusion 153 is arranged on one of the first encapsulation portion 130 and the second encapsulation portion 150, and the other one of the first encapsulation portion 130 and the second encapsulation portion 150 defines a receiving groove 136 adapted to the embedding protrusion 153. Therefore, the stability and reliability of the connection between the first encapsulation portion 130 and the second encapsulation portion 150 can be further enhanced. For example, in the example shown in FIG. 8, the first encapsulation portion 130 defines the receiving groove 136, and the embedding protrusion 153, which is adapted to the receiving groove 136, is arranged on the second encapsulation portion 150.

According to an embodiment of the present disclosure, as shown in FIG. 3, the embedding protrusion 153 may be arranged on the extension-embedding portion 152. Further, as shown in FIG. 8, there may be a plurality of the embedding protrusions 153 that are spaced apart. Accordingly, there also may define a plurality of the receiving grooves 136, which are correspondingly matched with the plurality of the embedding protrusions 153. Therefore, the stability and reliability of the connection between the first encapsulation portion 130 and the second encapsulation portion 150 can be further enhanced.

According to an embodiment of the present disclosure, the pins 121 include power pins 121*a* and data pins 121*b*. An expanded portion 1211 is arranged on at least one of the power pins 121*a*. A cross-sectional area of the expanded portion 1211 is larger than a cross-sectional area of the data pin 121*b* such that current load amount of the power pins 121*a* is increased. As the expanded portion 1211 is arranged on the power pins 121*a*, the current load amount of the power pins 121*a* can be increased, which can increase the current transmission speed and make the power interface 100 have a fast charging function to improve the charging efficiency of a battery.

According to an embodiment of the present disclosure, a pin-recess 1212 is defined at a position of the expanded portion 1211 that is close to the front end of the power pins 121*a*, that is, the expanded portion 1211 defines the pin-recess 1212 close to an end of the at least one of the power pins 121*a*. It should be noted that, when the power interface 100 performs the fast charging function, the power pins 121*a* with the expanded portion 1211 may be used to carry a large charging current. When the power interface 100 performs the normal charging function, the pin-recess 1212 on the expanded portion 1211 may make the power pins 130 prevented from being contacted with corresponding pins of a power adapter. Therefore, the power interface 100 in this embodiment can be applied to different power adapters. For example, when the power interface 100 performs the fast charging function, the power interface 100 can be electrically connected to a corresponding power adapter with the fast charging function. When the power interface 100 performs the normal charging function, the power interface 100 can be electrically connected to a corresponding normal power adapter. It should be noted that, the fast charging function herein may refer to a charging state in which the charging current is greater than or equal to 2.5 A or the rated output power is not less than 15 W, and the normal charging may refer to a charging state in which the charging current is less than 2.5 A or the rated output power is less than 15 W.

Figure 9:
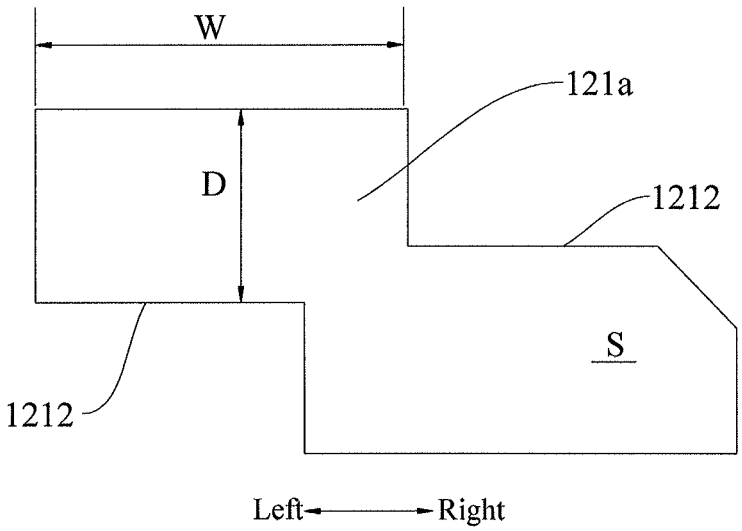
FIG. 9 is a structural schematic view of a power pin according to an embodiment of the present disclosure.
Figure 10:
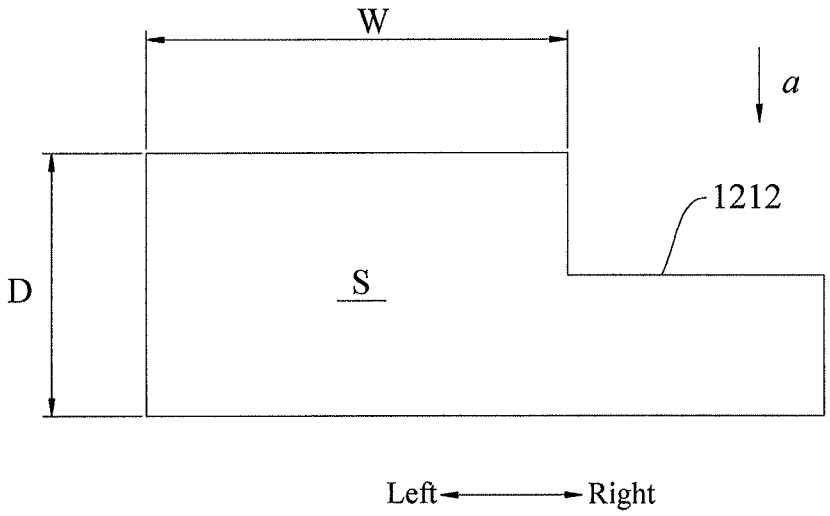
FIG. 10 is a structural schematic view of a power pin according to an embodiment of the present disclosure.

According to an embodiment of the disclosure, as shown in FIGS. 9 and 10, the cross-sectional area of the expanded portion 1211 may be defined as S, and $S \geq 0.09805\ mm^2$. It has been experimentally verified that when $S \geq 0.09805\ mm^2$, the current load amount of the power pins 121*a* may be at least 10 A. Therefore, the charging efficiency can be improved by increasing the current load amount of the power pins 121*a*. After further tests, when $S=0.13125\ mm^2$, the current load amount of the power pins 121*a* may be 12 A or more, which can improve charging efficiency.

According to an embodiment of the disclosure, as shown in FIGS. 9 and 10, the power pin 121*a* has a thickness D, which meets $0.1\ mm \leq D \leq 0.3\ mm$. It has been experimentally verified that when $0.1\ mm \leq D \leq 0.3\ mm$, the current load amount of the power pins 121*a* is at least 10 A, which can improve the charging efficiency by increasing the current load of the power pins 121*a*. After further tests, when $D=0.25\ mm$, the current load amount of the power pins 121*a* may be greatly increased, and the current load amount of the power pins 121*a* is 12 A or more, which can improve the charging efficiency.

According to an embodiment of the disclosure, as shown in FIGS. 9 and 10, the power pin 121*a* has a contact surface configured to be electrically connected to a conductive component, and in the width direction of the power pin 121*a*

(i.e., the left-right direction as shown in FIGS. 9 and 10), a width of the contact surface is defined as W, which meets 0.24 mm≤W≤0.32 mm. It has been experimentally verified that when 0.24 mm≤W≤0.32 mm, the current load amount of the power pin 130 is at least 10 A, which may improve the charging efficiency by increasing the current load amount of the power pins 121*a*. After further tests, when W=0.25 mm, the current load amount of the power pin 121*a* can be greatly increased. The current load of the power pins 121*a* is 12 A or more, which improves the charging efficiency.

The power interface 100 according to embodiments of the present disclosure is described in detail with reference to FIGS. 1-10. It is noted that, the following description only is exemplary, and is not limitation to the present disclosure.

For convenience to describe, an example where the power interface 100 is implemented as a Type-C interface is described. The Type-C interface may also be called an USB Type-C interface. The Type-C interface belongs to a type of an interface, and is a new data, video, audio and power transmission interface specification developed and customized by the USB standardization organization to solve the drawbacks present for a long time that the physical interface specifications of the USB interface are uniform, and that the power can only be transmitted in one direction.

The Type-C interface may have the following features: a standard device may declare its willing to occupy a VBUS (that is, a positive connection wire of a traditional USB) to another device through a CC (Configuration Channel) pin in the interface specification. The device having a stronger willing may eventually output voltages and currents to the VBUS, while the other device may accept the power supplied from the VBUS, or the other device may still refuse to accept the power; however, it does not affect the transmission function. In order to use the definition of the bus more conveniently, a Type-C interface chip (such as LDR6013) may generally classify devices into four types: DFP (Downstream-facing Port), Strong DRP (Dual Role Power), DRP, and UFP (Upstream-facing Port). The willingness of these four types to occupy the VBUS may gradually decrease.

The DFP may correspond to an adapter, and may continuously output voltages to the VBUS. The Strong DRP may correspond to a mobile power, and may give up outputting voltages to the VBUS only when the strong DRP encounters the adapter. The DRP may correspond to a mobile phone. Normally, the DRP may expect other devices to supply power to itself. However, when encountering a device that has a weaker willingness, the DRP may also output the voltages and currents to the device. The UFP will not output electrical power externally. Generally, the UFP is a weak battery device, or a device without any batteries, such as a Bluetooth headset. The USB Type-C interface may support the insertions both from a positive side and a negative side. Since there are four groups of power sources and grounds on both sides (the positive side and the negative side), the power supported by USB Type-C interface may be greatly improved.

The power interface 100 in this embodiment may be a USB Type-C interface, which may be applied to a power adapter with the fast charging function, or a normal power adapter. It should be noted that, the fast charging herein may refer to a charging state in which a charging current is greater than 2.5 A or the rated output power is not less than 15 W. The normal charging herein may refer to a charging state in which the charging current is less than or equal to 2.5 A or the rated output power is less than 15 W. That is, when the power interface 100 is charged by the power adapter with the fast charging function, the charging current is greater than or equal to 2.5 A or the rated output power is not less than 15 W. When the power interface 100 is charged by the normal power adapter, the charging current is less than 2.5 A or the rated output power is not less than 15 W.

In order to standardize the power interface 100 and a power adapter that is compatible with the power interface 100, a size of the power interface 100 may need to meet design requirements of a standard interface. For example, for the power interface 100 with 24 pins 121, the design requirements are that, its width (i.e. the width in the left-right direction of the power interface 100, and the left-right direction is shown in FIG. 1) is a. In order to make the power interface 100 in this embodiment meet the design standard, and the width of the power interface 100 in this embodiment (i.e. the width in the left-right direction of the power interface 100, and the left-right direction is shown in in FIG. 1) may also be a. In order to enable the power pins 121*a* to carry a large charging current in a limited space, some of the 24 pins 121 may be omitted, and the cross-sectional area of the power pin 121*a* may be expanded, which is used to carry a large load. The expanded part of the power pins 121*a* can be arranged at the position of the omitted pins 121. On one hand, the layout of the power interface 100 is optimized, and on the other hand, the ability of power pins 121*a* to carry current can be increased.

Specifically, as shown in FIGS. 1-8, the power interface 100 includes a housing 110 and a connection body 120. The connection body 120 includes a first encapsulation portion 130, a second encapsulation portion 150, and fourteen pins 121. The first encapsulation portion 130 and the second encapsulation portion 150 may be made from a material with a good heat dissipation effect, for example, polyamide resin (e.g., stanyl PA46). Polyamide resin has the following characteristics.

| Thermal characteristics | dry/cond | | |
|---|---|---|---|
| Thermal conductivity in plane | 2.1 | W/(m K) | ASTM E1461 |
| Thermal conductivity through plane | 0.9 | W/(m K) | ASTM E1461 |

It should be noted that, with those two encapsulation portions arranged on the connection body 120, the connection body 120 can have different characteristics. For example, the first encapsulation portion 130 and the second encapsulation portion 150 can be made from different materials. The connection body 120 can be made to meet different strength requirements by using different materials. In addition, the connection body 120 can also meet different heat dissipation requirements by selecting different materials. Of course, the connection body 120 can also have aesthetic appearance characteristics as the first encapsulation portion 130 and the second encapsulation portion 150 are used.

The fourteen pins 121 include six data pins 121*b* and eight power pins 121*a*. The six data pins 121*b* are marked with A5, A6, A7, B5, B6, and B7, respectively, and the eight power pins 121*a* are marked with A1, A4, A9, A12, B1, B4, B9, and B12, respectively. The eight power pins 121*a* include four VBUSs and four GNDs. A partition piece 122 is interposed between the opposite two GNDs. Both rear ends of the six data pins 121*b* and rear ends of the eight power pins 121*a* are electrically connected to a circuit board 160. Both the housing 110 and the partition piece 122 are welded to the circuit board 160.

It should be noted that, the power interface 100 may be disposed on a mobile terminal, and a battery can be disposed inside the mobile terminal (e.g., a mobile phone, a tablet computer, a notebook computer, etc.). The battery may be charged by an external power source via the power interface 100.

As shown in FIGS. 1-4 and 8, the partition piece 122 may have a head end 1223 and a tail end 1225. The head end 1223 may define a through hole 1221, and a reinforcing rib 232 may be arranged in the through hole 231. A reinforcing protrusion 1224 that protrudes away from the connection body 120 may be arranged at the head end 1223. The reinforcing protrusion 1224 may increase area of the contact surface between the partition piece 122 and the first encapsulation portion 130 or the second encapsulation portion 150, which may enhance the adhesion between the partition piece 122 and the first encapsulation portion 130 or the second encapsulation portion 150 and make the connection of the partition piece 122 become more stable. The tail end 1225 of the partition piece 122 can be welded to the circuit board 160, and the tail end 1225 can be spaced apart from the housing 110. In this way, the interference of the housing 110 and the partition piece 122 on an antenna of the mobile terminal can be reduced.

The power pins 121*a* may be supported by the partition piece 122 between the opposite two power pins 121*a*. A poor contact of a connection line of a power adapter with the power interface 100, which is caused when the opposite two power pins 121*a* deviate toward a direction that they are close to each other, may be prevented when the power adapter is inserted into the power interface 100. At the same time, the head end 1223 of the partition piece 122 defines the through hole 1221, and the reinforcing rib 1222 is disposed in the through hole 1221. Thus, not only the material of the partition piece 122 may be saved, but also the structural strength of the partition piece 122 may be improved.

The second encapsulation portion 150 is embedded in the first encapsulation portion 130, and a part of the outer surface of the second encapsulation portion 150 is configured as the front-end face 120*a* of the connection body 120. A part of the outer surface of the pins 121 is wrapped by the first encapsulation portion 130 and the second encapsulation portion 150, such that the connection body 120 is formed. The connection body 120 is disposed in the housing 110 and connected to the housing 110. It should be noted that a surface of the pins 121 uncovered by the first encapsulation portion 130 is configured to be an outer surface of the connection body 120, and the surface of the pins 121 uncovered by the first encapsulation portion 130 is adapted to be electrically connected to corresponding pins 121 in a power adapter. An engaging flange 131 is arranged at the rear end of the first encapsulation portion 130 close to the pins 121 (i.e., the rear side direction as shown in FIG. 1). That is, the engaging flange 131 is arranged adjacent an end of the pins 121.

As shown in FIGS. 6-7, a first stopping plate 111 is disposed on the inner wall 110*a* of the housing 110, and the first stopping plate 111 can be integrally formed with the housing 110 by injection molding. A second stopping plate 112 is also disposed on the inner wall 110*a* of the housing 110. The second stopping plate 112 is spaced apart from the first stopping plate 111, and the second stopping plate 112 is welded inside of the housing 110. The first stopping plate 111 and the second stopping plate 112 collectively define a stopping groove 113. The stopping groove 113 are extended in a circumferential direction of the connection body 120, that is, the stopping groove 113 extends along a circumferential direction of the inner wall 110*a* of the housing 110 and surrounds the connection body 120. The engaging flange 131 is engaged in the stopping groove 113. Therefore, the connection body 120 can be stably mounted in the housing 110. As shown in FIGS. 1 and 3, a plurality of engaging protrusions 132 are arranged on a free end face of the engaging flange 131, that is, the plurality of engaging protrusions 132 are circumferential arranged on the engaging flange 131 and surround the connection body 120, and the engaging flange 131 defines a plurality of engaging recesses 133. An engaging portion 114 is arranged in the stopping groove 113, which is adapted to the engaging protrusions 132. The plurality of engaging recesses 133 are spaced along the circumferential direction of the engaging flange 131, that is, the plurality of engaging recesses 133 are spaced along the circumferential direction of the connection body 120. As shown in FIGS. 6 and 7 together, a plurality of stopping protrusions 115 are arranged in the stopping groove 113, which are adapted to the engaging recesses 133. Therefore, the mating stability of the connection body 120 and the housing 110 may be further improved.

An adhesive layer is disposed between the first encapsulation portion 130 and the inner peripheral wall of the housing 110, that is, the adhesive layer is circumferentially disposed between the first encapsulation portion 130 and the inner wall 110*a* of the housing 110. On the one hand, the connection body 120 can be firmly and stably assembled with the housing 110. On the other hand, the connection body 120 and the housing 110 can be connected together by the adhesive layer, and the plugging strength of the power interface 100 also can be improved, which delays the fatigue damage of the power interface 100 due to repeated plug-in and plug-out actions.

As shown in FIGS. 3-4, the first encapsulation portion 130 defines a body-embedding notch 134 and an extension-embedding notch 135. Correspondingly, the second encapsulation portion 150 includes a body-embedding portion 151 and an extension-embedding portion 152. The body-embedding portion 151 is connected to the extension-embedding portion 152. The body-embedding portion 151 is adapted to the body-embedding notch 134, and the extension-embedding portion 152 is adapted to the extension-embedding notch 135. A front-end face 152*a* of the extension-embedding portion 152 is configured to be the front-end face 120*a* of the connection body 120. That is, one face of the extension-embedding portion 152 is configured as the front-end face 120*a* of the entire connection body 120. Therefore, in other words, the outer surfaces of the extension-embedding portion 152 and the body-embedding portion 151 are configured as the part of the surface of the connection body 120. Thus, the first encapsulation portion 130 and the second encapsulation portion 150 can be stably connected together. It can be understood that the pins 121 are wrapped by the first encapsulation portion 130 and the second encapsulation portion 150 such that the connection body 120 is formed. Due to the body-embedding portion 151 and the body-embedding notch 134, and the extension-embedding portion 152 and the extension-embedding notch 135, the pins 121, the first encapsulation portion 130, and the second encapsulation portion 150 are firmly assembled together, which may improve the structural strength and assembly stability of the connection body 120.

As shown in FIG. 3 and FIG. 8, the first encapsulation portion 130 defines a plurality of receiving grooves 136 spaced apart from each other, and a plurality of embedding protrusions 153, which are adapted to the receiving grooves 136, are arranged on the second encapsulation portion 150. The plurality of the embedding protrusions 153 are spaced apart from each other, which match with the plurality of receiving grooves 136. Therefore, the stability and reliability of the connection between the first encapsulation portion 130 and the second encapsulation portion 150 can be further enhanced.

As shown in FIGS. 1-4, the pins 121 include power pins 121*a* and data pins 121*b*. An expanded portion 1211 is arranged at middle of the power pins 121*a*. A cross-sectional area of the expanded portion 1211 is larger than a cross-sectional area of the data pin 121*b* such that current load amount of the power pins 121*a* is increased. As the expanded portion 1211 is arranged on the power pins 121*a*, the current load amount of the power pins 121*a* can be increased, which can increase the current transmission speed and make the power interface 100 have the fast charging function to improve the charging efficiency of a battery.

A pin-recess 1212 is defined at a position of the expanded portion 1211 that is close to the front end of the power pins 121*a*. It should be noted that, when the power interface 100 performs the fast charging function, the power pins 121*a* with the expanded portion 1211 may be used to carry a large charging current. When the power interface 100 performs the normal charging function, the pin-recess 1212 on the expanded portion 1211 may make the power pins 130 prevented from being contacted with corresponding pins of a power adapter. Therefore, the power interface 100 in this embodiment can be applied to different power adapters. For example, when the power interface 100 performs the fast charging function, the power interface 100 can be electrically connected to a corresponding power adapter with the fast charging function. When the power interface 100 performs the normal charging function, the power interface 100 can be electrically connected to a corresponding normal power adapter.

As shown in FIGS. 9-10, the cross-sectional area of the expanded portion 1211 is defined as S, the thickness of the power pin 121*a* is defined as D, and the power pin 121*a* has a contact surface suitable for electrical connection with a conductive member. In the width direction of power pin 121*a* (i.e., the left-right direction shown in FIGS. 9-10), the width of the contact surface is defined as W. When S=0.13125 mm2, D=0.25 mm, and W=0.25 mm, the current load amount of the power pins 121*a* can be greatly increased. The current load amount of the power pin 121*a* may be 10 A, 12 A, 14 A or more. Thus, the charging efficiency can be improved.

As described above, since the plurality of pins 121 are wrapped together by the first encapsulation portion 130, the structural strength of the connection body 120 can be enhanced, and fatigue damage of the connection body 120 may be delayed during repeated plug-in and plug-out actions of the power interface 100. In addition, since the expanded portions 1211 are arranged on the power pins 121*a*, the current load amount of the power pins 121*a* can be increased. Thus, the current transmission speed can be improved, and the power interface 100 has a fast charging function, and the charging efficiency of a battery can be improved.

A mobile terminal according to an embodiment of the present disclosure includes the power interface 100 as described above. The mobile terminal can implement the transmission of electrical signals and data signals through the power interface 100. For example, the mobile terminal can be electrically connected to a power adapter through the power interface 100 to implement a charging or data transmission function.

The mobile terminal according to the embodiment of the present disclosure may effectively conduct heat generated by the current when it is charged through the first encapsulation portion made from polyamide resin with high conductivity and good heat dissipation effect. Therefore, it is implemented that the power interface may have the fast charging function.

A power adapter according to an embodiment of the present disclosure includes the power interface 100 as described above. The power adapter can implement the transmission of electrical signals and data signals through the power interface 100.

The power adapter according to the embodiment of the present disclosure may effectively conduct heat generated by the current when it is charged through the first encapsulation portion made from polyamide resin with high conductivity and good heat dissipation effect. Therefore, it is implemented that the power interface may have the fast charging function.

Figure 11:
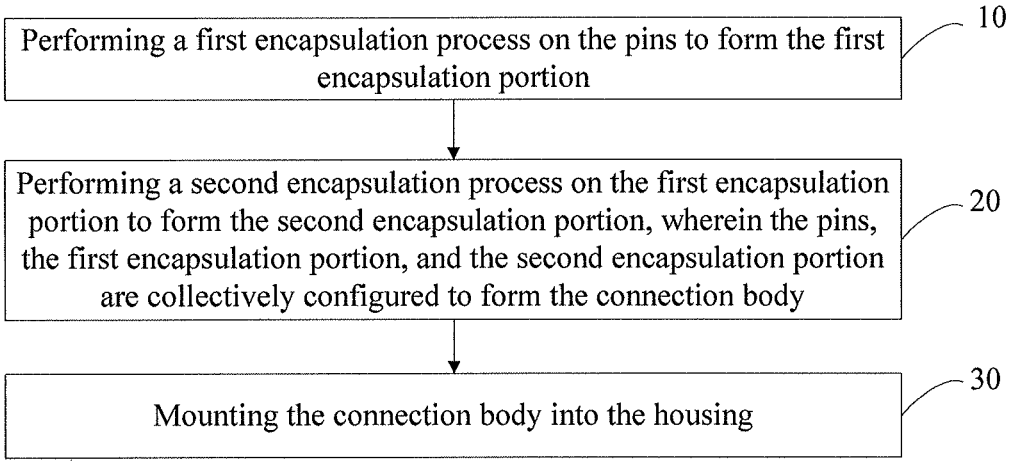
FIG. 11 is a flow chart of a method for manufacturing a power interface according to an embodiment of the present disclosure.

FIG. 11 illustrates a method for manufacturing a power interface according to an embodiment of the present disclosure, wherein the power interface includes a housing and a connection body. Specifically, the connection body is disposed in the housing, and the connection body has a first encapsulation portion, a second encapsulation portion and a plurality of spaced pins. The first encapsulation portion and the second encapsulation portion cooperatively wrap a partial outer surface of the pins and the first encapsulation is connected to the housing. The second encapsulation portion is embedded in the first encapsulation portion, and a part of the outer peripheral wall of the second encapsulation portion is configured to be a front-end face of the connection body. At least one of the first encapsulation portion and the second encapsulation portion is encapsulation portion with polyamide resin.

The method for manufacturing the power interface includes the following actions in the following blocks.

At block 10, a first encapsulation process is performed on the pins to form the first encapsulation portion.

At block 20, a second encapsulation process is performed on the first encapsulation portion to form the second encapsulation portion, wherein the pins, the first encapsulation portion, and the second encapsulation portion are collectively configured to form the connection body.

At block 30, the connection body is mounted into the housing.

In the method for manufacturing the power interface according to an embodiment of the present disclosure, as the two encapsulation portions are arranged on the connection body, the connection body can have different characteristics. For example, the first encapsulation portion and the second encapsulation portion can be made from different materials. The connection body can be made to meet different strength requirements by using different materials. In addition, the connection body can also meet different heat dissipation requirements by selecting different materials. Of course, the connection body can also have aesthetic appearance characteristics as the first encapsulation portion and the second encapsulation portion are used.

Moreover, heat generated by the current when it is charged may effectively conducted through the first encapsulation portion made from polyamide resin with high conductivity and good heat dissipation effect. Therefore, it is implemented that the power interface may have the fast charging function.

According to an embodiment of the present disclosure, at the block 30, an adhesive layer is disposed between the first encapsulation portion and the inner peripheral wall of the housing. On one hand, the connection body can be firmly and stably assembled with the housing. On the other hand, the connection body and the housing can be connected together by the adhesive layer, and the plugging strength of the power interface also can be improved, which delays the fatigue damage of the power interface due to repeated plug-in and plug-out actions.

In one embodiment, as shown in FIGS. 1-10, a mobile terminal may include a circuit board 160 and a power interface 100 connected to the circuit board 160. The power interface 100 may include a housing 110 and a connection body 120. The housing 110 has an inner wall 110*a* defining a stopping groove 113. The connection body 12Q is disposed in the housing 110 and configured to connected to the circuit board 160. The connection body 120 may include a first encapsulation portion 130 and a plurality of pins 121 spaced apart. The pins 121 is wrapped by the first encapsulation portion 130 and a partial outer face of each of the pins 121 is exposed by the first encapsulation portion 130, and the first encapsulation portion 130 is connected to the housing 110. The first encapsulation portion 130 is made from polyamide resin and has an engaging flange 131 adjacent an end of the pins 121, and the engaging flange 131 is engaged in the stopping groove 113.

In one embodiment, as shown in FIGS. 1-10, a power interface 100 may include a housing 110 and an insertion body 120 received in the housing 110. The insertion body 120 may include a plurality of pins 121, an encapsulation 140, and a plurality of spaced engaging flanges 132. The encapsulation 140 is connected to the housing 110 and wrapped the pins 121 partially such that a partial outer surface of each of the pins 121 is exposed out of the encapsulation 140. The encapsulation 140 is made from polyamide resin. The plurality of spaced engaging flanges 132 extending out from an external circumference of the encapsulation 140 adjacent to an end of the pins 121. In one example, the encapsulation 140 may include a first encapsulation 130 and a second encapsulation 150. In another example, the encapsulation 140 may refer to the first encapsulation 130.

In one example, as shown in FIG. 1, each two adjacent pins 121 are insulated by the encapsulation 140, and exposed outer surfaces of the each two adjacent pins 121 are coplanar with an outer surface of the encapsulation 140 between the each two adjacent pins 121.

In another example, each two adjacent pins are insulated by the encapsulation 140, and exposed outer surfaces of the each two adjacent pins 121 extend beyond an outer surface of the encapsulation 140 between the each two adjacent pins 121.

In one example, the housing 110 defines a plurality of recesses (not shown), and the engaging flanges 132 are engaged in the recesses.

In one example, as shown in FIGS. 1 and 3 two adjacent engaging flanges 132 define a groove 133, and a protrusion extends from the housing to be engaged in the groove 133.

In one example, as shown in FIGS. 1 and 3. the engaging flanges 132 extend along a direction perpendicular to an extending direction of the pins 21.

Reference throughout this specification, the reference terms "an embodiment", "some embodiments", "an example", "a specific example", or "some examples", and the like means that a specific feature, structure, material, or characteristic described in connection with the embodiment or example is included in at least one embodiment or example of the present disclosure. Thus, the illustrative descriptions of the terms throughout this specification are not necessarily referring to the same embodiment or example of the present disclosure. Furthermore, the specific features, structures, materials, or characteristics may be combined in any suitable manner in one or more embodiments or examples. In addition, one skilled in the art may combine the different embodiments or examples described in this specification and features of different embodiments or examples without conflicting with each other.

Although explanatory embodiments have been shown and described, it would be appreciated by one skilled in the art that the above embodiments previously described are illustrative, and cannot be construed to limit the present disclosure. Changes, alternatives, and modifications can be made in the embodiments without departing from scope of the present disclosure.

What is claimed is:

1. A power interface, comprising:

a housing having an inner wall, the inner wall defining a stopping groove; and a connection body, disposed in the housing and comprising a first encapsulation portion, a second encapsulation portion, and a plurality of pins spaced apart, wherein partial outer periphery of the pins is wrapped by the first encapsulation portion, and the first encapsulation portion is connected to the housing, the first encapsulation portion is made from polyamide resin and has an engaging flange arranged at a rear end of the pins, and the engaging flange is engaged in the stopping groove, the second encapsulation portion is embedded in the first encapsulation portion, and a partial outer peripheral wall of the second encapsulation portion is configured as a front-end surface of the connection body;

wherein the engaging flange has a first engaging protrusion arranged at two opposite first sides of the engaging flange respectively and a plurality of second engaging protrusions arranged at two opposite second sides of the engaging flange respectively; wherein the first sides are perpendicular to the second sides; an engaging portion is arranged on the inner wall where the stopping groove is defined, and the first engaging protrusion and the second engaging protrusions are engaged with the engaging portion.

2. The power interface of claim 1, wherein an adhesive layer is disposed between the first encapsulation portion and an inner peripheral wall of the housing.

3. The power interface of claim 1, wherein the second encapsulation portion is made from polyamide resin.

4. The power interface of claim 1, wherein the stopping groove extends along a circumferential direction of the connection body.

5. The power interface of claim 4, wherein a stopping protrusion is disposed on the inner wall where the stopping groove is disposed, and the stopping protrusion is embedded in the first encapsulation portion.

6. The power interface of claim 1, wherein a front end of the pins is protruded from the first encapsulation portion;

the first encapsulation portion defines a body-embedding notch and an extension-embedding notch;

the second encapsulation portion comprises a body-embedding portion and an extension-embedding portion connected to the body-embedding portion;

the body-embedding portion is embedded in the body-embedding notch, and the extension-embedding portion is embedded in the extension-embedding notch; and the front end of the pins is wrapped by the extension-embedding portion, and a front-end surface of the extension-embedding portion is configured as the front-end surface of the connection body.

7. The power interface of claim 6, wherein the extension-embedding portion comprises a first portion and a second portion perpendicular to the first portion, the front end of the pins is wrapped by the second portion, and an outer side surface of the second portion is configured as the front-end surface of the connection body; and the embedding protrusion is arranged on the first portion of the extension-embedding portion.

8. The power interface of claim 6, wherein an embedding protrusion is arranged on the extension-embedding portion of the second encapsulation portion, and a receiving groove adapted to the embedding protrusion is defined in the first encapsulation portion.

9. The power interface of claim 8, wherein there are a plurality of embedding protrusions that are spaced apart, and there are a plurality of receiving grooves correspondingly matched with the plurality of embedding protrusions.

10. The power interface of claim 1, wherein the pins comprise power pins and data pins, a power pin has an expanded portion, and a cross-sectional area of the expanded portion is greater than that of each of the data pins to increase current load of the power pin.

11. The power interface of claim 10, wherein a recess is defined at a position of the expanded portion that is close to a front end of the power pins.

12. The power interface of claim 10, wherein the cross-sectional area of the expanded portion is defined as S, and $S \geq 0.09805\ mm^2$.

13. The power interface of claim 12, wherein $S=0.13125\ mm^2$.

14. The power interface of claim 10, wherein a thickness of each of power pins is defined as D, and $0.1\ mm \leq D \leq 0.3\ mm$.

15. The power interface of claim 14, wherein D=0.25 mm.

16. The power interface of claim 10, wherein the power pin comprises a contact surface configured to contact with an electronic element; a width of the contact surface along the width direction of each of the power pins is defined W, and $0.24\ mm \leq W \leq 0.32\ mm$.

17. The power interface of claim 16, wherein W=0.25 mm.

18. A mobile terminal, comprising a power interface, wherein the power interface comprises:

a housing having an inner wall, the inner wall defining a stopping groove; and a connection body, disposed in the housing and comprising a first encapsulation portion, a second encapsulation portion, and a plurality of pins spaced apart, wherein partial outer periphery of the pins is wrapped by the first encapsulation portion, and the first encapsulation portion is connected to the housing, the first encapsulation portion is made from polyamide resin and has an engaging flange arranged at a rear end of the pins, and the engaging flange is engaged in the stopping groove, the second encapsulation portion is embedded in the first encapsulation portion, and a partial outer peripheral wall of the second encapsulation portion is configured as a front-end surface of the connection body;

wherein the engaging flange has a first engaging protrusion arranged at two opposite first sides of the engaging flange respectively and a plurality of second engaging protrusions arranged at two opposite second sides of the engaging flange respectively; wherein the first sides are perpendicular to the second sides; an engaging portion is arranged on the inner wall where the stopping groove is defined, and the engaging protrusions are engaged with the engaging portion.

19. A method for manufacturing a power interface comprising:

a housing;

a connection body, disposed in the housing and comprising a first encapsulation portion, a second encapsulation portion, and a plurality of pins spaced apart, wherein partial outer periphery of the pins is wrapped by the first encapsulation portion and the second encapsulation portion, the first encapsulation portion is connected to the housing, the second encapsulation portion is embedded in the first encapsulation portion, a part of an outer peripheral wall of the second encapsulation portion is configured to be a front-end surface of the connection body, and at least one of the first encapsulation portion and the second encapsulation portion is made from polyamide resin; and the first encapsulation portion has an engaging flange arranged at a rear end of the pins;

wherein the engaging flange has a first engaging protrusion arranged at two opposite first sides of the engaging flange respectively and a plurality of second engaging protrusions arranged at two opposite second sides of the engaging flange respectively; wherein the first sides are perpendicular to the second sides; an engaging portion is arranged on the inner wall where the stopping groove is defined; and the engaging protrusions are engaged with the engaging portion;

the method comprising:

S10) performing a first encapsulation process on the pins to form the first encapsulation portion;

S20) performing a second encapsulation process on the first encapsulation portion to form the second encapsulation portion, wherein the pins, the first encapsulation portion, and the second encapsulation portion are collectively configured to form the connection body;

S30) mounting the connection body into the housing.

20. The method of claim 19, wherein an adhesive layer is disposed between the first encapsulation portion and the inner peripheral wall of the housing at S30.

* * * * *